US010925415B1

(12) United States Patent
Butler

(10) Patent No.: US 10,925,415 B1
(45) Date of Patent: Feb. 23, 2021

(54) SELF-LEVELING PICTURE FRAME APPARATUS

(71) Applicant: Thomas Butler, Wisconsin Dells, WI (US)

(72) Inventor: Thomas Butler, Wisconsin Dells, WI (US)

( * ) Notice: Subject to any disclaimer, the term of this patent is extended or adjusted under 35 U.S.C. 154(b) by 0 days.

(21) Appl. No.: 16/696,735

(22) Filed: Nov. 26, 2019

(51) Int. Cl.
*A47G 1/06* (2006.01)
*A47G 1/14* (2006.01)

(52) U.S. Cl.
CPC ..... *A47G 1/06* (2013.01); *A47G 1/142* (2013.01); *A47G 2001/0677* (2013.01); *A47G 2001/0694* (2013.01); *A47G 2400/086* (2013.01)

(58) Field of Classification Search
CPC ..... A47G 2400/086
USPC ..... 40/713
See application file for complete search history.

(56) References Cited

U.S. PATENT DOCUMENTS

| | | | | |
|---|---|---|---|---|
| 3,365,827 | A | 1/1968 | Leif | |
| 4,944,094 | A | 7/1990 | Depiano | |
| 5,463,817 | A | 11/1995 | Leeds | |
| 5,848,489 | A * | 12/1998 | Hartley | A47G 1/0616 40/713 |
| 6,138,369 | A | 10/2000 | Mushin | |
| 2009/0283657 | A1* | 11/2009 | Silvers | F16M 13/02 248/550 |
| 2010/0012813 | A1* | 1/2010 | Mickel | A47G 1/24 248/495 |

FOREIGN PATENT DOCUMENTS

| | | |
|---|---|---|
| WO | WO9824085 | 6/1998 |

* cited by examiner

*Primary Examiner* — Kristina N Junge

(57) ABSTRACT

A self-leveling picture frame apparatus for automatically leveling pictures hung on a wall includes a frame body having an upper portion, a lower portion, a left portion, and a right portion defining a frame aperture. A leveling liquid is coupled within a leveling cavity of the frame body. The leveling cavity is shaped to direct the leveling liquid towards a midline of either the upper portion, the lower portion, the left portion, or the right portion depending on which portion is lowest. A transparent front cover is coupled to the frame body. The front cover is coupled to a front face of the frame body within the frame aperture. A back cover is coupled to a back face of the frame body over the frame aperture.

12 Claims, 8 Drawing Sheets

SELF-LEVELING PICTURE FRAME APPARATUS

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

The disclosure relates to picture frame devices and more particularly pertains to a new picture frame device for automatically leveling pictures hung on a wall.

(2) Description of Related Art Including Information Disclosed Under 37 CFR 1.97 and 1.98

The prior art relates to picture frame devices. Traditional picture frames can be difficult to hang properly and typically require an external tool, such as a level, to ensure they are straight. Existing frame devices have incorporated integrated levels or other mechanisms to aid a user in hanging the frame but do nothing to ensure the frame remains level if knocked or otherwise touched. What is needed, and what the present invention provides, is a picture frame device which not only aids in the initial hanging, but also maintains a level orientation after being touched or otherwise manipulated.

BRIEF SUMMARY OF THE INVENTION

An embodiment of the disclosure meets the needs presented above by generally comprising a frame body having an upper portion, a lower portion, a left portion, and a right portion defining a frame aperture. A leveling liquid is coupled within a leveling cavity of the frame body. The leveling cavity is shaped to direct the leveling liquid towards a midline of either the upper portion, the lower portion, the left portion, or the right portion depending on which portion is lowest. A transparent front cover is coupled to the frame body. The front cover is coupled to a front face of the frame body within the frame aperture. A back cover is coupled to a back face of the frame body over the frame aperture.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
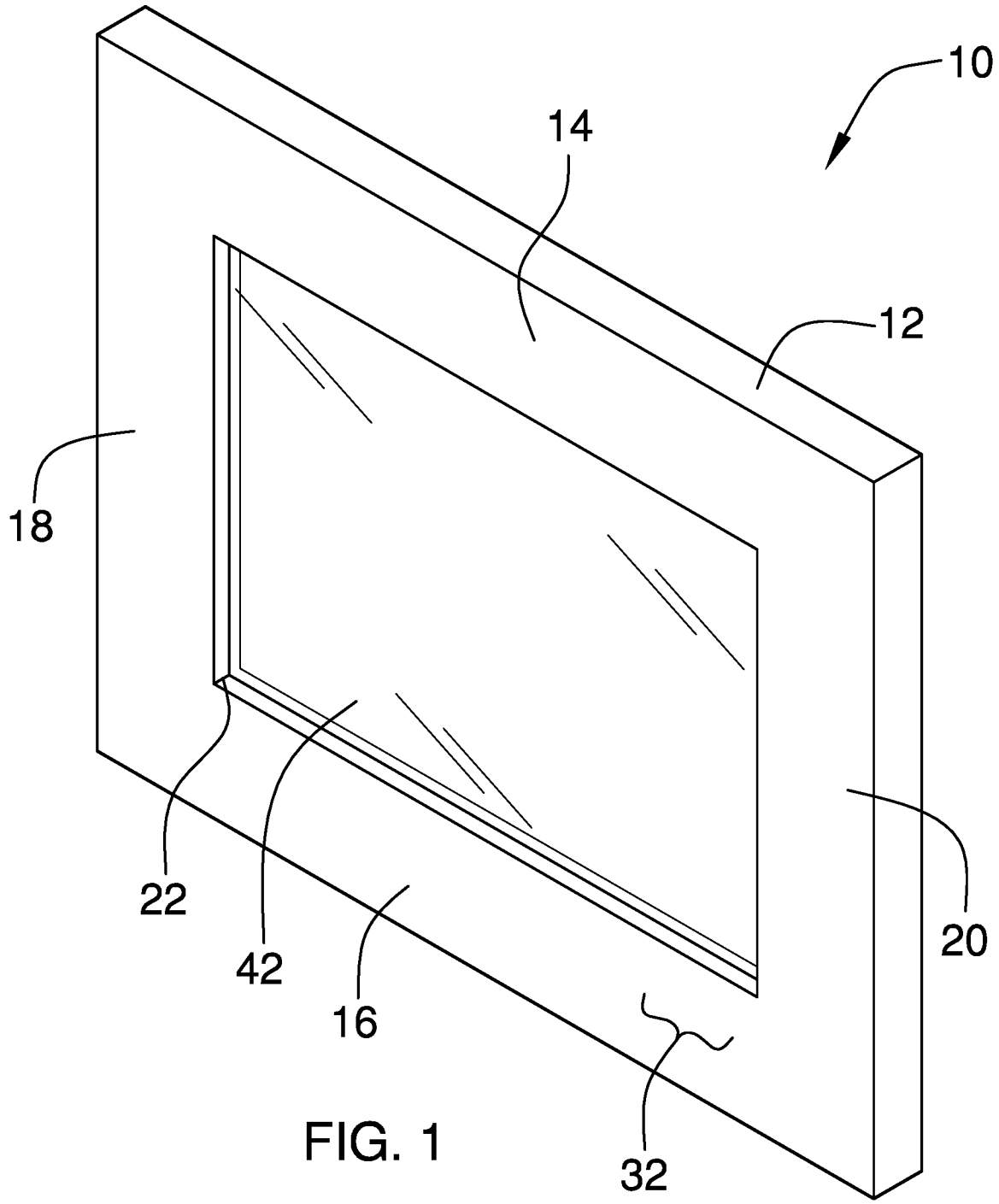
FIG. 1 is an isometric view of a self-leveling picture frame apparatus according to an embodiment of the disclosure.
Figure 2:
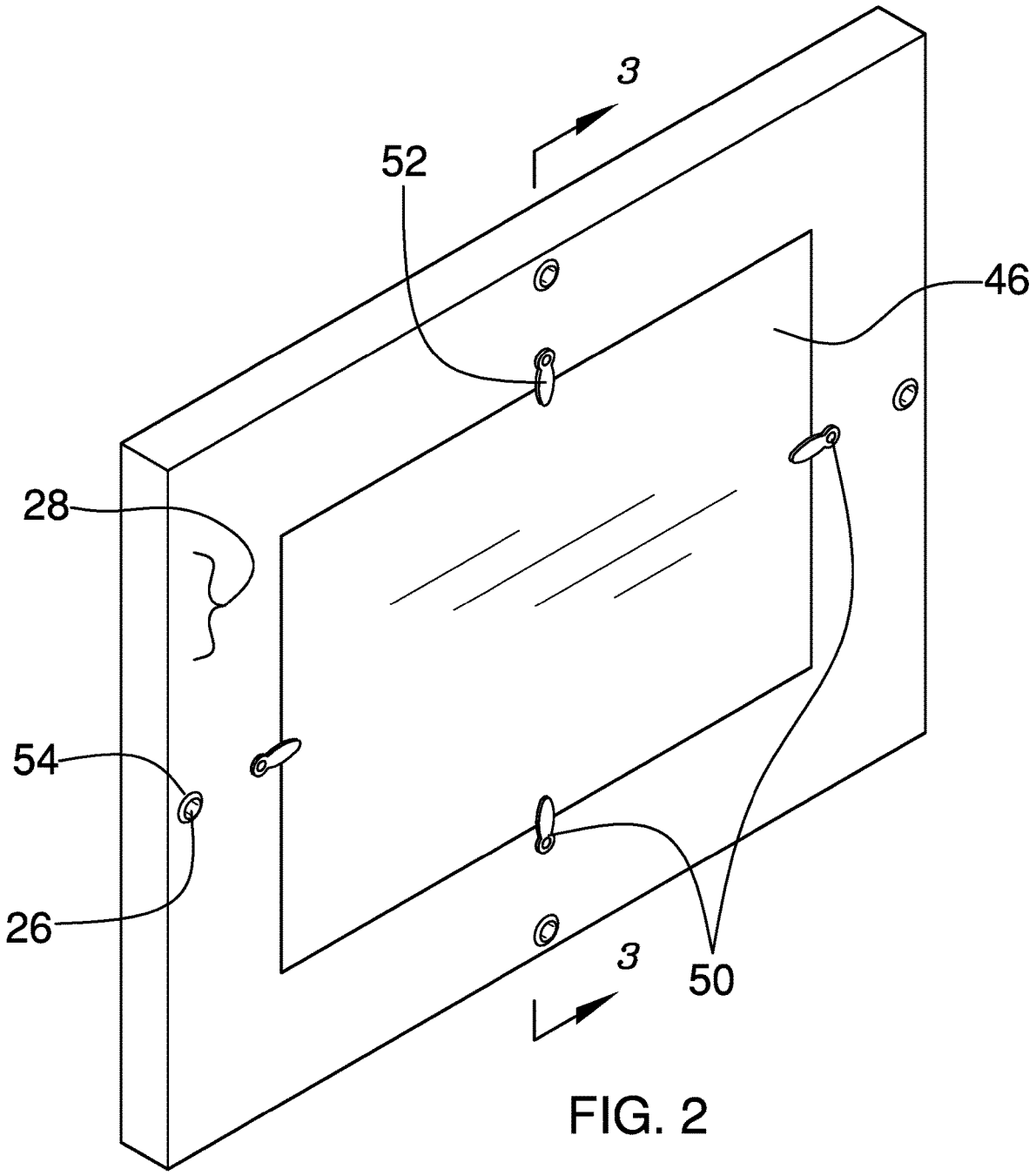
FIG. 2 is an isometric view of an embodiment of the disclosure.
Figure 3:
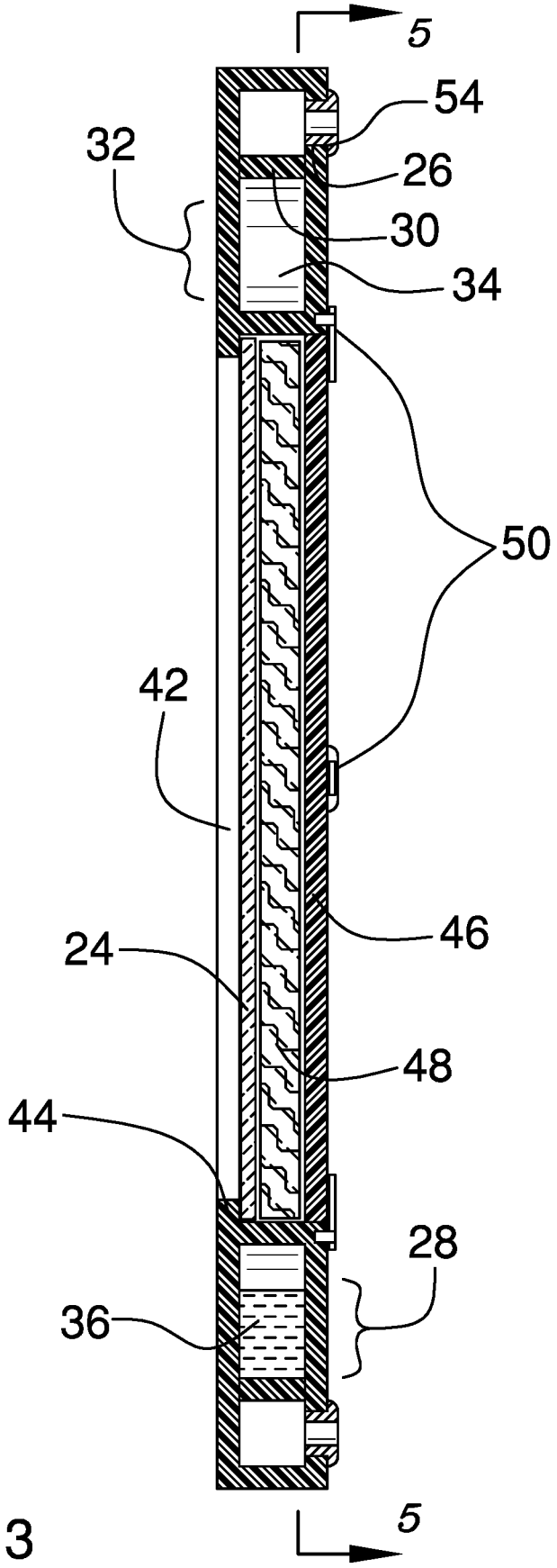
FIG. 3 is a cross-sectional view of an embodiment of the disclosure.
Figure 4:
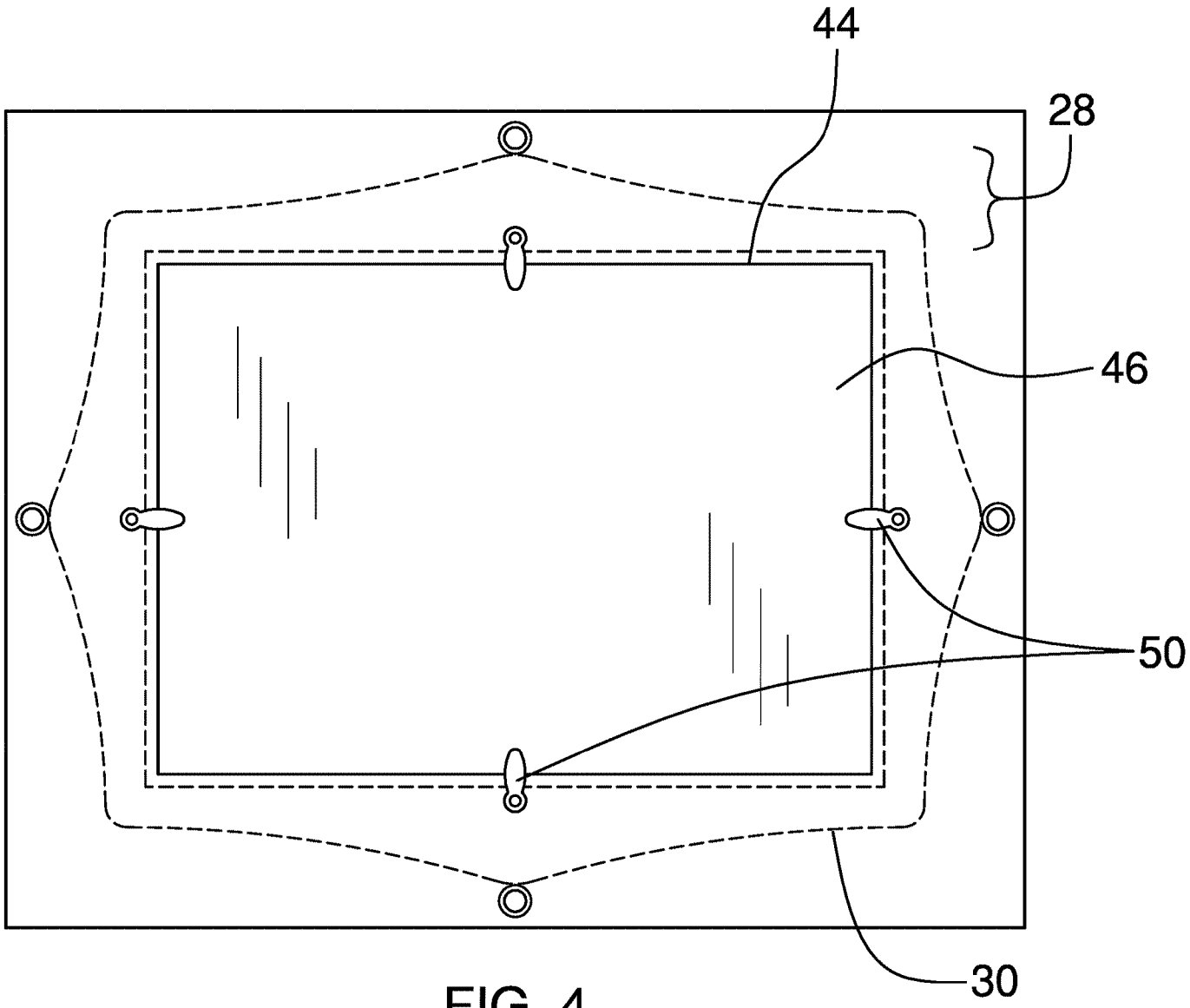
FIG. 4 is a rear elevation view of an embodiment of the disclosure.
Figure 5:
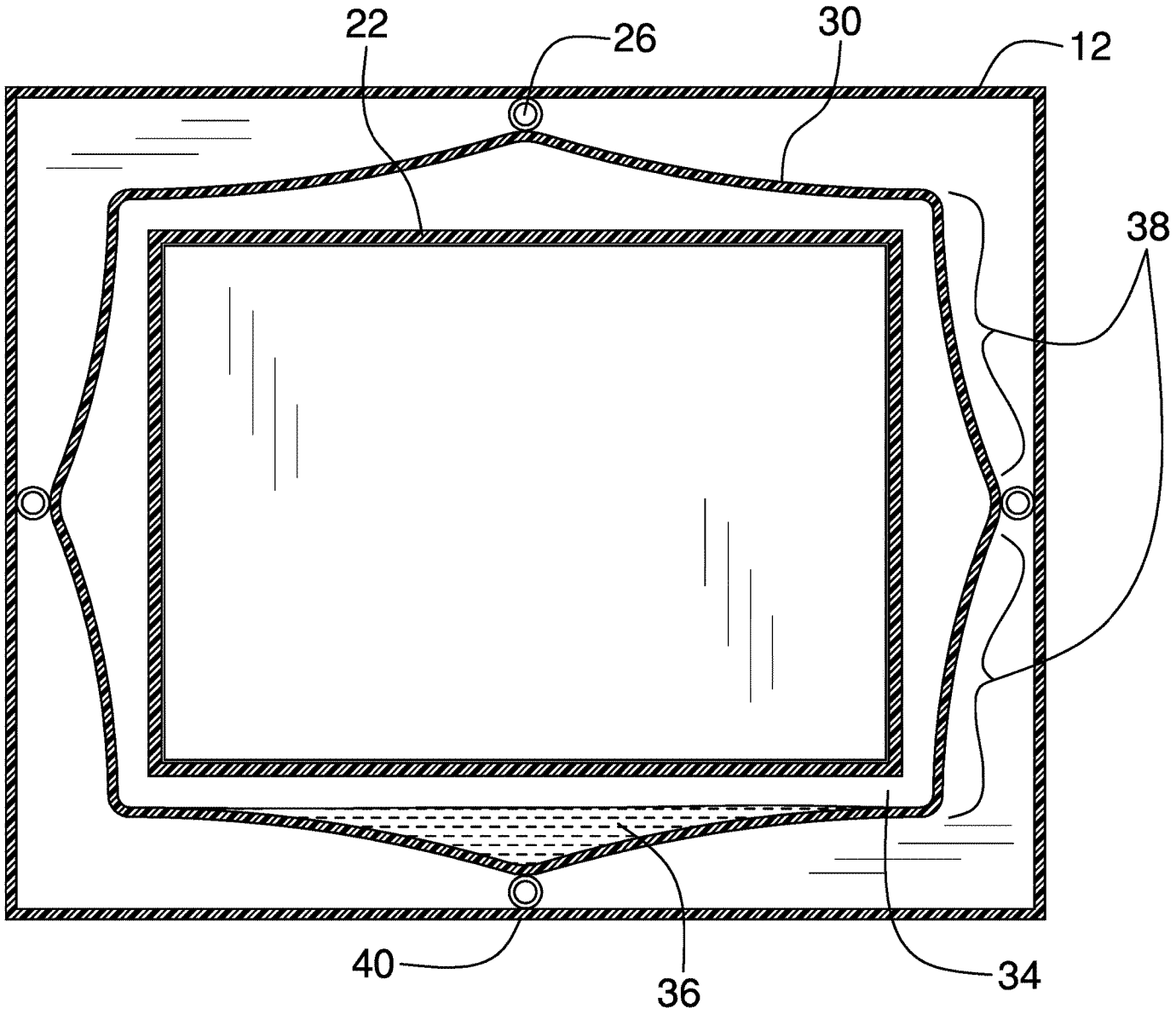
FIG. 5 is a cross-sectional view of an embodiment of the disclosure.
Figure 6:
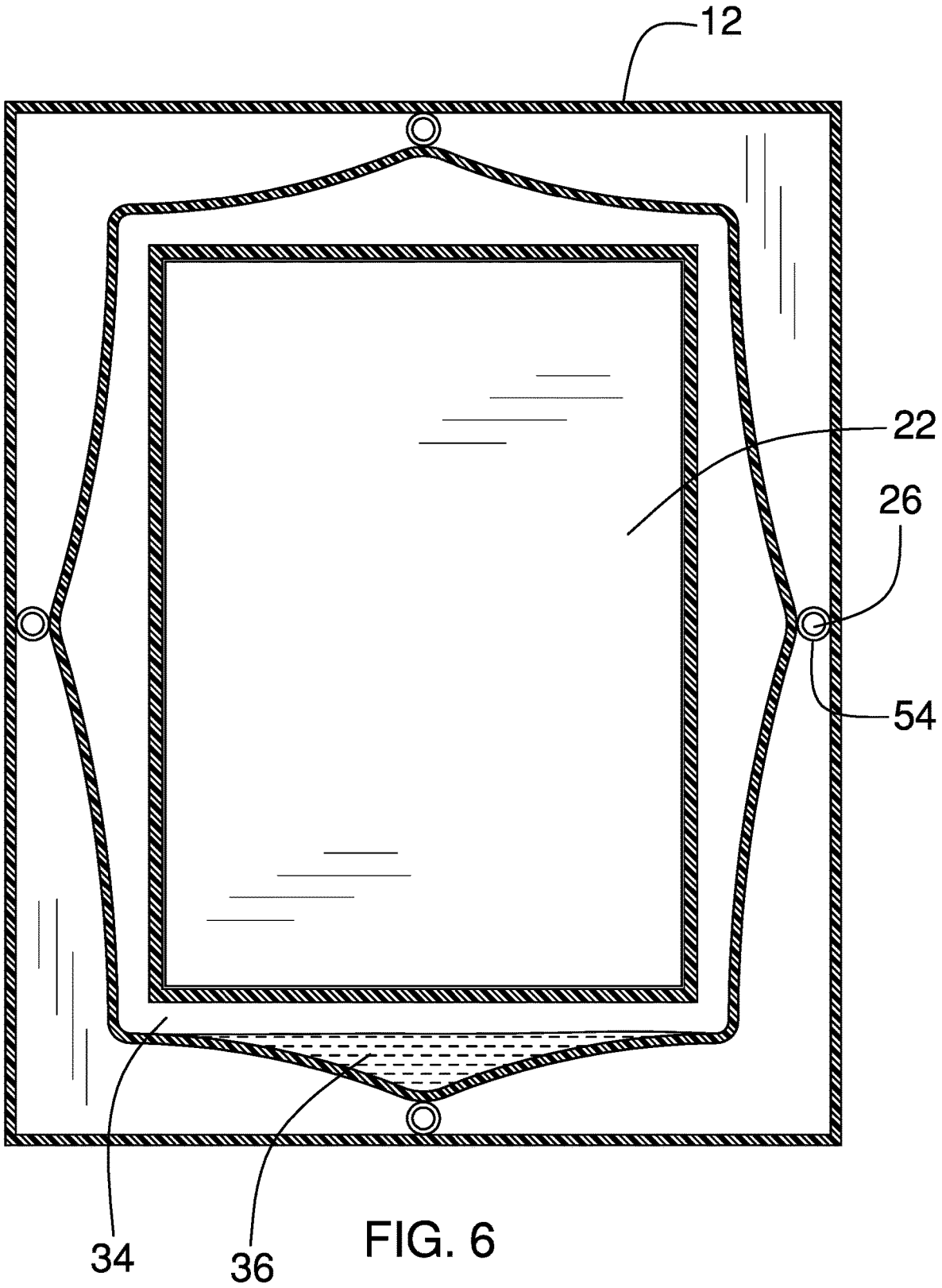
FIG. 6 is a cross-sectional view of an embodiment of the disclosure.
Figure 7:
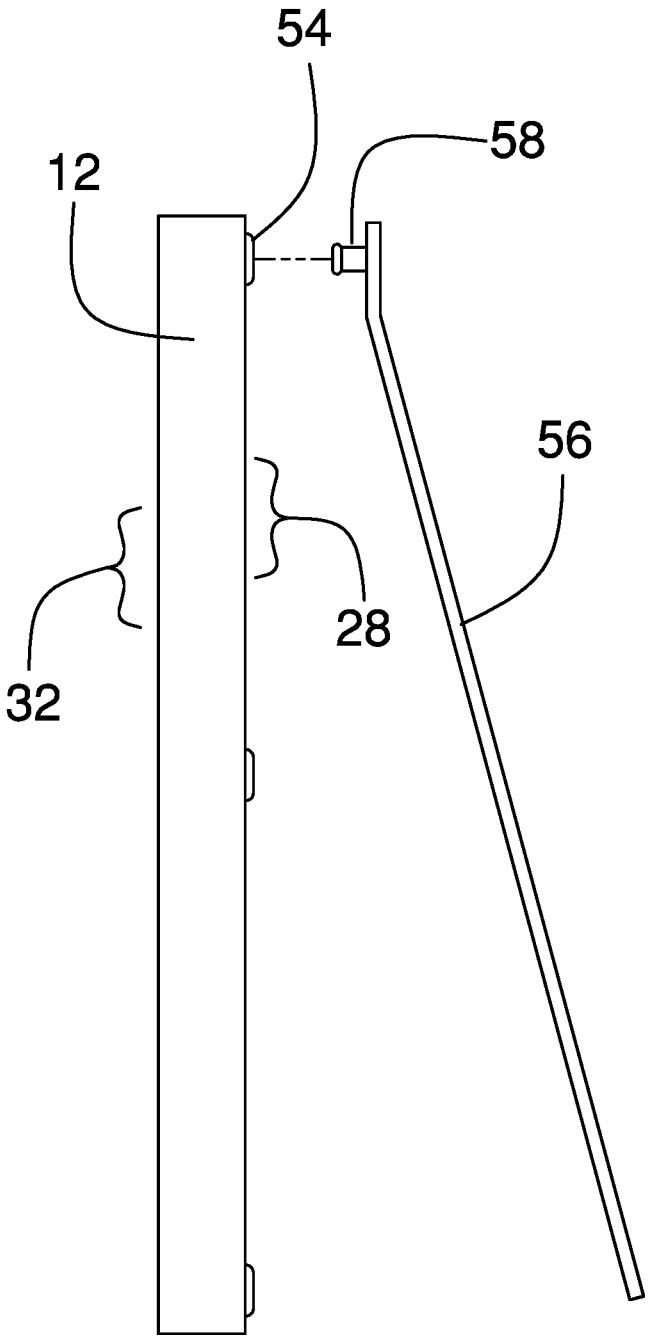
FIG. 7 is a side elevation view of an embodiment of the disclosure.
Figure 8:
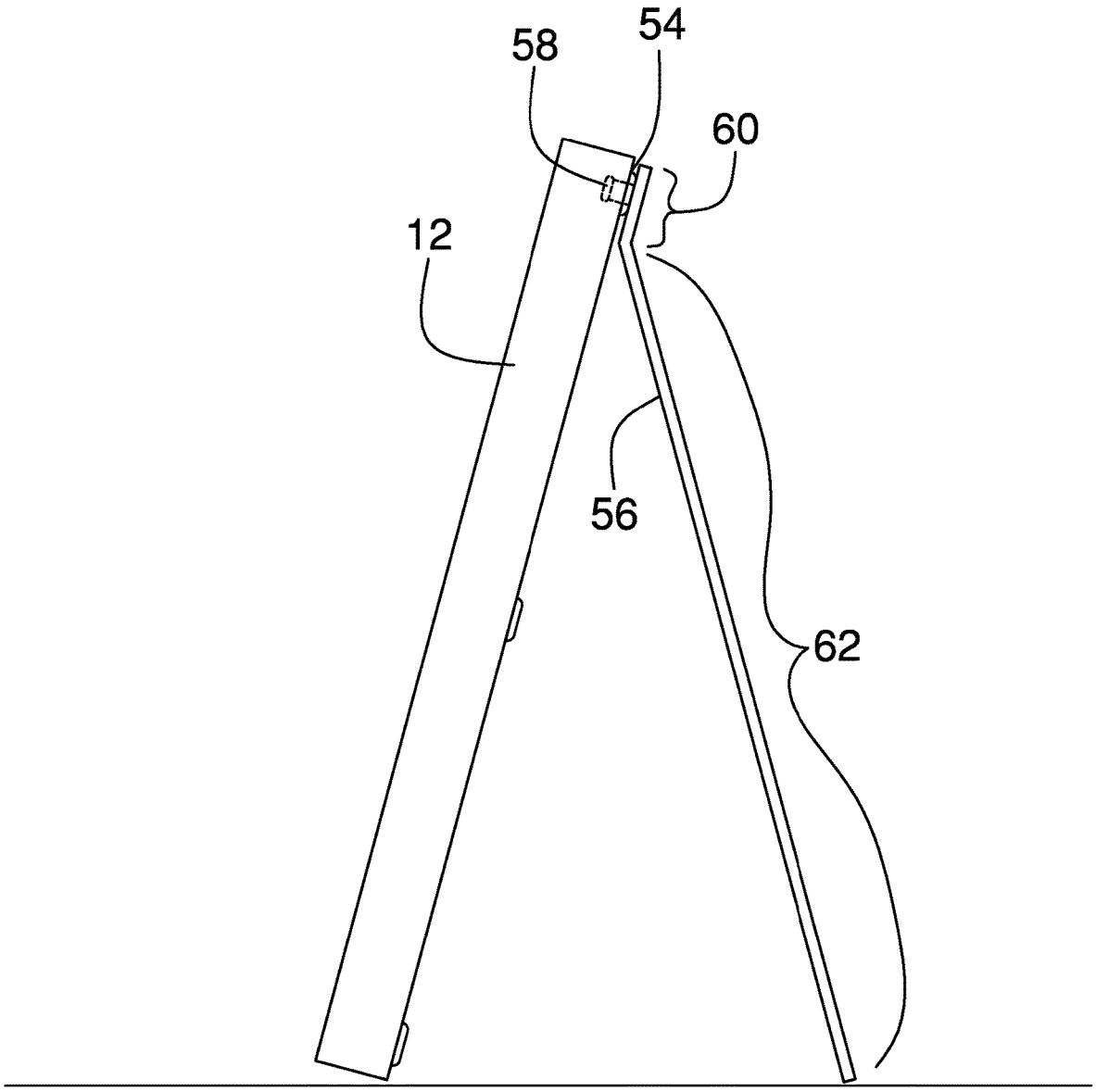
FIG. 8 is an in-use view of an embodiment of the disclosure.

With reference now to the drawings, and in particular to FIGS. 1 through 8 thereof, a new picture frame device embodying the principles and concepts of an embodiment of the disclosure and generally designated by the reference numeral 10 will be described.

As best illustrated in FIGS. 1 through 8, the self-leveling picture frame apparatus 10 generally comprises a frame body 12 having an upper portion 14, a lower portion 16, a left portion 18, and a right portion 20 defining a frame aperture 22. The frame aperture 22 is dimensioned and configured to secure a standard size photograph 24 and may be a rectangle with sides proportioned 2:3, 3:5, 3:4, 4:5, 5:7, or 9:16. Each of the upper 14, lower 16, left 18, and right portions 20 is hollow. There may be at least one mounting aperture 26 extending through a back face 28 of the frame body. The mounting apertures 26 may be used to mount the apparatus 10 on a wall with traditional mounting hardware. The frame body 12 has a divider wall 30 extending between a front face 32 and the back face 28 to define a leveling cavity 34 with a perimeter of the frame aperture 22.

A leveling liquid 36 is coupled within the leveling cavity 34. The leveling cavity 34 is shaped to direct the leveling liquid 36 towards a midline of either the upper portion 14, the lower portion 16, the left portion 18, or the right portion 20 depending on which portion is lowest. The leveling liquid 36 thus changes the center of gravity of the apparatus 10 to automatically level the frame body 12 when hung on the wall. The frame body 12 may have a single orientation with the mounting aperture 26 extending through the portion opposite the portion of the leveling cavity 34. Alternatively, the leveling cavity 34 may continuously extend through each of the upper 14, lower 16, left 18, and right portions 20, and each portion may have one mounting aperture 26 extending therethrough. The frame body 12 may thus be oriented in any direction and will still self-level. The divider wall 30 may have a pair of convex portions 38 within each of the upper 14, lower 16, left 18, and right portions 20. The convex portions 38 are convex relative the frame aperture 22 and extend from proximal the corner of the frame aperture 22 to convene at the midline closer to an outer perimeter 40 of the frame body. The divider wall 30 directs and stores the leveling liquid 36 in a manner that concentrates more leveling liquid 36 closer to the midline and prevents the leveling liquid 36 from pooling close to the corners. The leveling liquid 36 will thus orient the frame body 12 to a level position when it is initially hung or if it is bumped. The leveling liquid 36 may be non-hazardous in case the frame body 12 were to break and a user would contact the leveling liquid 36. The leveling liquid 36 may also have a freezing point below 0° centigrade to prevent solidification in cold environments. The leveling liquid 36 may be, but is not limited to, antifreeze, coolant, or other non-hazardous, low-freezing point liquids.

A transparent front cover 42 is coupled to the front face 32 of the frame body within the frame aperture 22. There may be a lip 44 extending around the perimeter of the frame aperture to secure the front cover 42 flush with the front face 22. The front cover 42 may be, but is not limited to, glass, acrylic, or other transparent materials. A back cover 46 is coupled to the back face 28 of the frame body over the frame aperture 22. A filler board 48 may be selectively engageable within the mounting aperture 22 between the front cover 42 and the back cover 46. The photograph 24 may thus be placed between the front cover 42 and the filler board 48 to be secured in place without moving. A plurality of cover clips 50 is coupled to the back face 28 of each of the upper, lower, left, and right portions adjacent the frame aperture 22 to selectively engage the back cover 46. The cover clips 50 may be pivotably coupled to the back face 28 with an arm portion 52 selectively extending over the back cover 46. The cover clips 50 may alternatively be flexible tabs that may be bent over the back cover.

A mounting bushing 54 may be coupled within each mounting aperture 26. The mounting bushings 54 protect the frame body 12 from damage and also allow easy engagement with a table stand 56. The table stand 56 has an attachment pin 58 extending from a head portion 60 to selectively engage the mounting bushing 54. A leg portion 62 of the table stand is hingingly coupled to the head portion 60 and extends down to prop the apparatus 10 up on a horizontal surface.

In use, the photograph 24 is placed between the front cover 42 and the filler board 48 and the back cover 46 is placed over the frame aperture 22. The cover clips 50 are then engaged with the back cover 46. The frame body 12 is then either hung on the wall with hardware engaging one of the mounting bushings 54, or the table stand 56 is engaged with the mounting bushing 54 for use on a horizontal surface.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A self-leveling picture frame apparatus comprising:
- a frame body having an upper portion, a lower portion, a left portion, and a right portion defining a frame aperture, the frame body having a leveling cavity;
- a leveling liquid coupled within the leveling cavity, the leveling cavity being shaped to direct the leveling liquid towards a midline of either the upper portion, the lower portion, the left portion, or the right portion depending on which portion is lowest;
- a transparent front cover coupled to the frame body, the front cover being coupled to a front face of the frame body within the frame aperture; and
- a back cover coupled to the frame body, the back cover being coupled to a back face of the frame body over the frame aperture.

2. The self-leveling picture frame apparatus of claim 1 further comprising the leveling cavity continuously extending through each of the upper, lower, left, and right portions.

3. The self-leveling picture frame apparatus of claim 1 further comprising each of the upper, lower, left, and right portions being hollow, the frame body having a divider wall extending between the front face and the back face and defining the leveling cavity with a perimeter of the frame aperture.

4. The self-leveling picture frame apparatus of claim 3 further comprising the divider wall having a pair of convex portions within each of the upper, lower, left, and right portions, the convex portions being convex relative the frame aperture and extending from proximal the corner of the frame aperture to convene at the midline closer to an outer perimeter of the frame body.

5. The self-leveling picture frame apparatus of claim 4 further comprising the leveling liquid being non-hazardous and having a freezing point below 0° centigrade.

6. The self-leveling picture frame apparatus of claim 1 further comprising a plurality of cover clips coupled to the back face of each of the upper, lower, left, and right portions adjacent the frame aperture, the cover clips selectively engaging the back cover.

7. The self-leveling picture frame apparatus of claim 1 further comprising at least one mounting aperture extending through the back face of the frame body.

8. The self-leveling picture frame apparatus of claim 7 further comprising the mounting apertures being a set of four mounting apertures extending through the midline of each of the upper, lower, left, and right portions.

9. The self-leveling picture frame apparatus of claim 7 further comprising a mounting bushing coupled within each mounting aperture.

10. The self-leveling picture frame apparatus of claim 9 further comprising a table stand, an attachment pin of the table stand being selectively engageable with the mounting bushing.

11. The self-leveling picture frame apparatus of claim 1 further comprising a filler board, the filler board being selectively engageable within the mounting aperture between the front cover and the back cover.

12. A self-leveling picture frame apparatus comprising:

a frame body having an upper portion, a lower portion, a left portion, and a right portion defining a frame aperture, the frame body having a leveling cavity, each of the upper, lower, left, and right portions being hollow, the frame body having a divider wall extending between a front face and a back face and defining the leveling cavity with a perimeter of the frame aperture, the leveling cavity continuously extending through each of the upper, lower, left, and right portions, the back face having at least one mounting aperture extending therethrough;

a leveling liquid coupled within the leveling cavity, the leveling cavity being shaped to direct the leveling liquid towards a midline of either the upper portion, the lower portion, the left portion, or the right portion depending on which portion is lowest, the divider wall having a pair of convex portions within each of the upper, lower, left, and right portions, the convex portions being convex relative the frame aperture and extending from proximal the corner of the frame aperture to convene at the midline closer to an outer perimeter of the frame body, the leveling liquid being non-hazardous and having a freezing point below 0° centigrade;

a transparent front cover coupled to the frame body, the front cover being coupled to the front face of the frame body within the frame aperture;

a back cover coupled to the frame body, the back cover being coupled to the back face of the frame body over the frame aperture;

a plurality of cover clips coupled to the back face of each of the upper, lower, left, and right portions adjacent the frame aperture, the cover clips selectively engaging the back cover;

a filler board, the filler board being selectively engageable within the mounting aperture between the front cover and the back cover;

a mounting bushing coupled within each mounting aperture; and comprising a table stand, an attachment pin of the table stand being selectively engageable with the mounting bushing.

* * * * *